United States Patent [19]

Wojdylo

[11] Patent Number: 5,009,508

[45] Date of Patent: Apr. 23, 1991

[54] APPARATUS FOR MIXING CONCRETE

[76] Inventor: Henry K. Wojdylo, 3816 Diamond Head Rd., Honolulu, Hi. 96816-4434

[21] Appl. No.: 498,716

[22] Filed: Mar. 26, 1990

[51] Int. Cl.[5] ..... B28C 5/06; B01F 13/02; B01F 15/02

[52] U.S. Cl. ..... 366/10; 366/107; 366/137; 366/101

[58] Field of Search ..... 366/3, 5, 10, 11, 13, 366/33, 34, 40, 101, 102, 106, 107, 136, 137

[56] References Cited

U.S. PATENT DOCUMENTS

| | | | |
|---|---|---|---|
| 1,553,476 | 9/1925 | Schuster | 366/5 |
| 3,048,377 | 8/1962 | Braitsch | 366/27 |
| 3,667,735 | 6/1972 | Hood | 366/10 |
| 3,667,736 | 6/1972 | Carroll | 366/27 |
| 3,802,669 | 4/1974 | Nohmura | 366/3 |
| 3,810,604 | 5/1974 | Reiter | 366/101 X |
| 4,002,323 | 1/1977 | Grun | 366/102 |
| 4,002,325 | 1/1977 | Herfeld | 366/10 X |
| 4,168,913 | 9/1979 | Kono | 366/3 |
| 4,285,602 | 8/1981 | Hagerty et al. | 366/101 X |
| 4,298,288 | 11/1981 | Weisbrod | 366/8 |
| 4,466,082 | 8/1984 | Zoschak et al. | 366/136 X |
| 4,838,701 | 6/1989 | Smith et al. | 366/136 |

FOREIGN PATENT DOCUMENTS

| | | | |
|---|---|---|---|
| 2502582 | 1/1975 | Fed. Rep. of Germany | 366/101 |

*Primary Examiner*—William A. Cuchlinski, Jr.
*Assistant Examiner*—Joseph A. Rhoa
*Attorney, Agent, or Firm*—Henderson & Sturm

[57] ABSTRACT

An apparatus for mixing concrete which includes a tank having at least a portion thereof which permits the inside of the tank to be visually observed from the outside of the tank. An inlet is disposed in the top of the tank for inserting concrete ingredients. An outlet is disposed in the bottom of the tank for permitting the mixed concrete to be withdrawn from a chamber inside the tank. The tank includes seals for selectively sealing all openings into the chamber of the tank and an opening is provided for introducing air under pressure into a lower portion of the tank for the purpose of being able to mix the concrete using such air pressure.

3 Claims, 3 Drawing Sheets

Water
Air
Water
Air

APPARATUS FOR MIXING CONCRETE

TECHNICAL FIELD

The present invention relates generally to an apparatus for mixing concrete and more particularly to an apparatus which is useful for mixing and delivering concrete at the job site, such as for multi-story buildings.

BACKGROUND ART

One of the ways that concrete is mixed and delivered at the job site for multi-story buildings is to use a conventional pear-shaped rotary concrete mixer for mixing a combination of cement, sand and water. Small batches of concrete are mixed in this way and then transferred to a smaller container. This smaller container is then lifted up to whichever level or story that it is needed. It is then dumped and the container is lowered for refilling. This is a time consuming and labor intensive procedure and consequently, other devices and methods are needed for increasing the efficiency of this process.

Another way that concrete is transferred to where it is needed it to use a transporter which includes a gear pump to pump concrete through steel pipes. This transporter typically always stays on the ground, even though the mixed concrete must go up to higher levels. The steel pipe through which the concrete passes generally consists of straight pipe pieces and it is very difficult to deliver the concrete to the place where it is needed because of the difficulty of connecting straight pieces of steel pipe to deliver to a place which is not in a straight line from the transporter.

Accordingly, there is a need for better methods and improved devices for mixing and delivering concrete to where it is needed, particularly at multi-story construction sites.

DISCLOSURE OF THE INVENTION

The present invention relates generally to an apparatus for mixing concrete which includes a tank having at least a portion thereof which permits the inside of the tank to be visually observed from the outside of the tank. An inlet is disposed in the top of the tank for inserting concrete ingredients. An outlet is disposed in the bottom of the tank for permitting the mixed concrete to be withdrawn from a chamber inside the tank. The tank includes seals for selectively sealing all openings into the chamber of the tank and an opening is provided for introducing air under pressure into a lower portion of the tank for the purpose of being able to mix the concrete using such air pressure.

Nozzles are provided in the lower portion of the tank chamber for either admitting air under pressure for mixing the water, cement and aggregate or, alternatively for introducing water for rinsing out and cleaning the inside of the chamber. Air pressure is also introduced through the nozzles once the concrete is mixed for delivering concrete through the outlet for forcing the concrete to wherever it is to be delivered by using the air pressure within the tank.

An object of the present invention is to provide an improved concrete mixing apparatus.

Another object of the present invention is to provide a concrete mixing apparatus which uses air pressure to mix the concrete.

A further object of the present invention is to provide a concrete mixing apparatus which has a way to observe the mixing of the concrete ingredients therein so that the proper amount of mixing can be accomplished and to monitor whether the correct viscosity is being obtained.

A still further object of the present invention is to provide a way to clean a concrete mixing apparatus by spraying water into the interior of the tank.

A still further object of the present invention is to provide a way to easily transfer concrete from a mixing tank to the job site by using air pressure within the tank to transfer the mixed concrete.

Other objects, advantages, and novel features of the present invention will become apparent from the following detailed description of the invention when considered in conjunction with the accompanying drawings.

BEST MODE FOR CARRYING OUT THE INVENTION

Figures 1, 2, 3, 4:
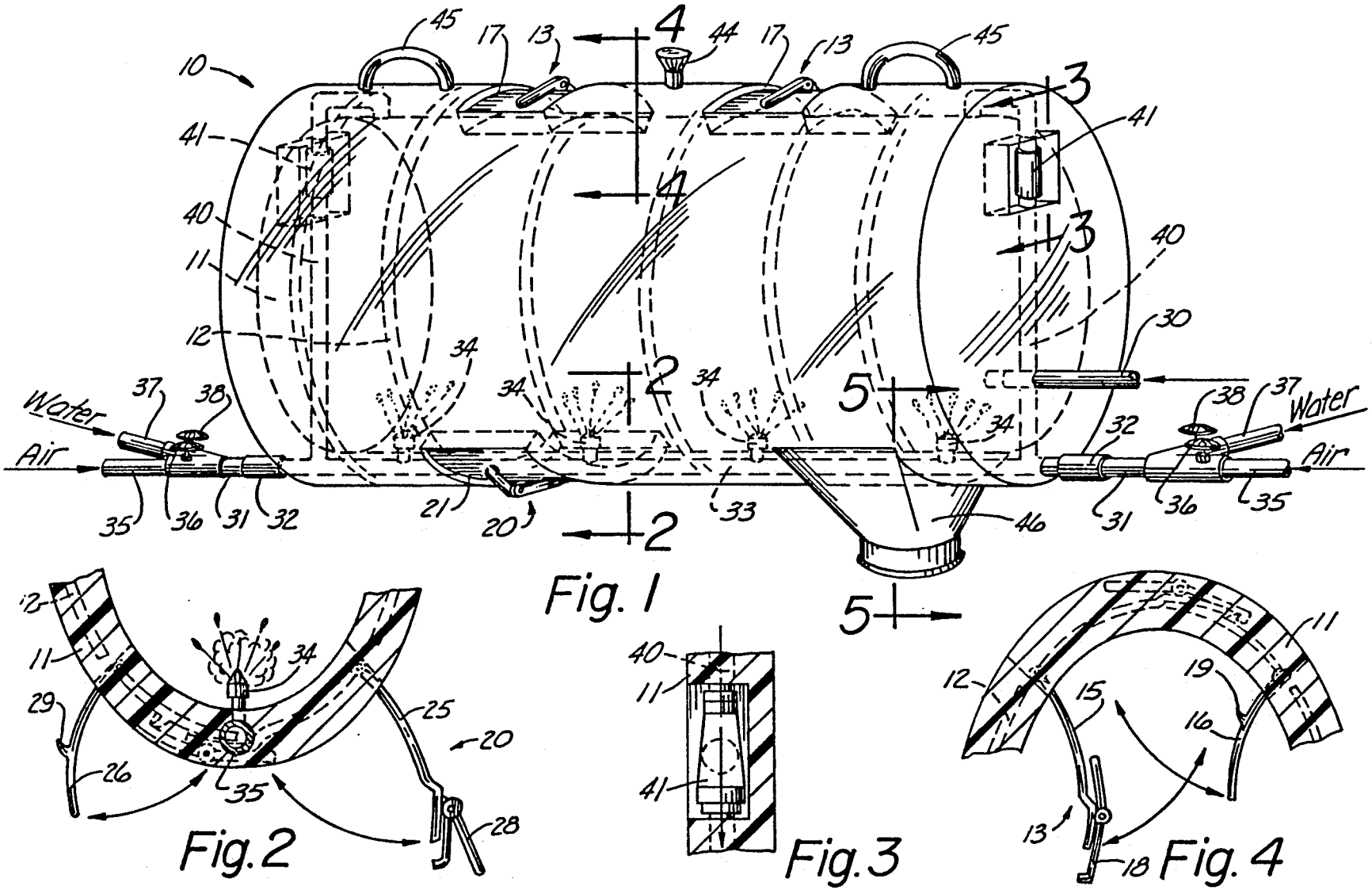
FIG. 1 is a perspective view of a preferred embodiment of the present invention showing a clear concrete mixing tank with various additional features.
FIG. 2 is an enlarged cross sectional view taken along line 2—2 of FIG. 1.
FIG. 3 is an enlarged cross sectional view taken along line 3—3 of FIG. 1.
FIG. 4 is an enlarged cross sectional view taken along line 4—4 of FIG. 1.

Referring now to the drawings wherein like reference numerals designate identical or corresponding parts throughout the several views, FIG. 1 shows an apparatus (10) for mixing and delivering concrete to a job site. The tank portion (11) is constructed of a clear plastic material with reinforcing rods (12) molded therein for added strength. This clear plastic material can be one of many things for example, an acrylic plastic. Alternatively, high-density polyethylene, while it tends to be more translucent than transparent, may be used to the extent that the level and viscosity of the concrete within the tank can be observed. Additionally, the entire tank (11) does not need to be constructed of a transparent material if a large enough vertical height portion of the tank is clear enough to observe the mixing and viscosity information about what is going on inside of the tank (11).

Inlet doors (13) are shown in FIGS. 1 and 4 and include portions (15) and (16) which are pivotally attached to the tank (11) at openings (17). These inlet doors (13) have over center connecting buckles (18) which connect to a protuberance (19) on door portion (16) to hold the inlet doors (13) sealed closed when desired. These buckles (18) can be similar to the type used on old storage trunks or suitcases, but they could consist of many other devices as well. In fact, the doors (13) can be a one-piece door with a latch on it instead of the configuration shown in FIG. 4.

Outlet doors (20) are connected to the tank (11) at openings (21). These outlet doors (20) are similar to the inlet door (13) except that they fold outwardly for release of the concrete therethrough, rather than inwardly as the doors (13) shown in FIG. 4. These outlet doors (20) also have pivoted door portions (25) and (26) pivotally attached to the tank (11). These pivoting portions (25) and (26) also have a buckle (28) and a protuberance (29) for selectively latching and sealing the doors to the closed position, as shown in FIG. 1.

Figure 6:
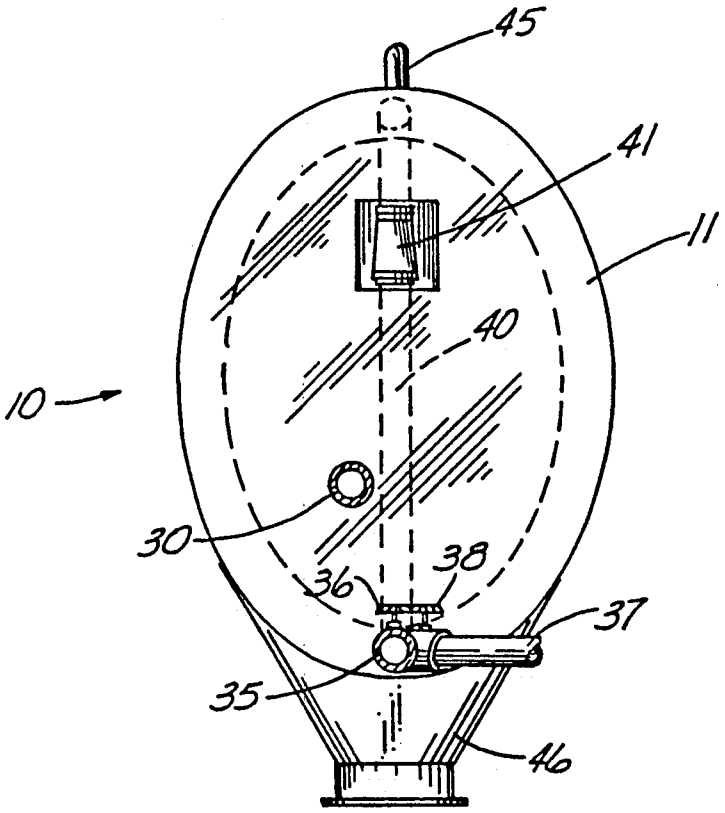
FIG. 6 is a view of the right end of the preferred embodiment shown in FIG. 1.
Figure 5:
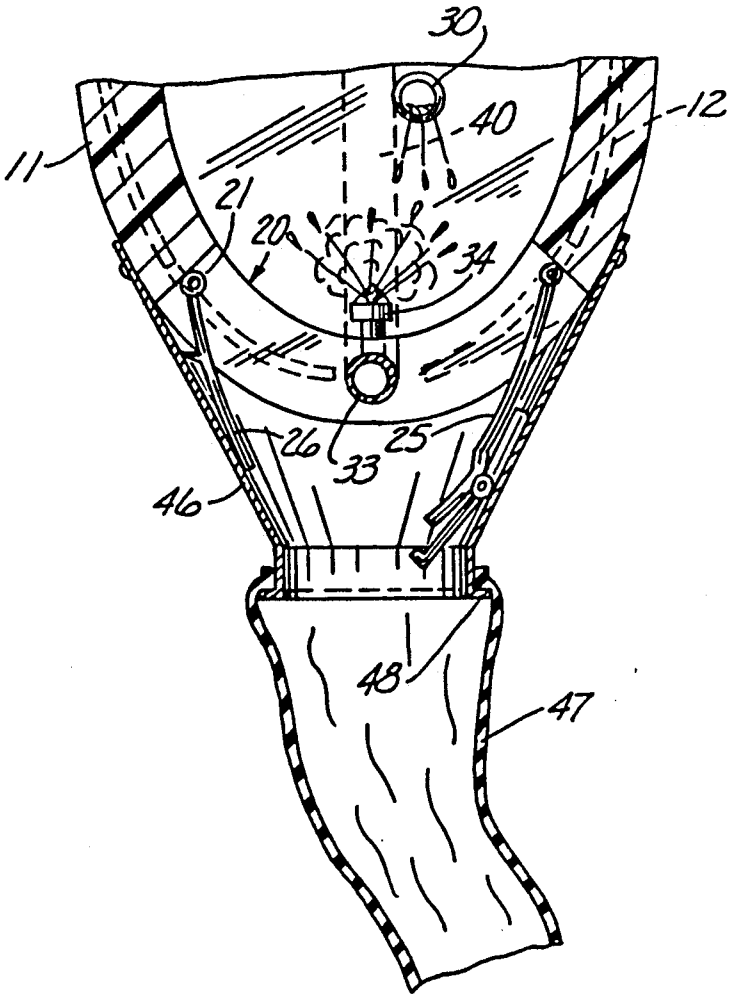
FIG. 5 is a cross sectional view taken along line 5—5 of FIG. 1.

A water inlet (30) is provided on one end of the tank (11) as can be seen in FIGS. 1, 5 and 6. Also, an inlet (31) is provided on each end thereof and has a one-way check valve (32) in the line for selectively either allowing air to enter a pipe (33) inside of the walls of the tank (11) through pipe (35) and valve (36) or, water through pipe (37) and valve (38).

Nozzles (34) are connected at numerous places along the pipe (33) and exit through the lower wall of the tank (11). When air under pressure is being introduced into the inner-chamber of the tank (11), air passes through the nozzles (34) and, alternatively, when water passes through the pipe (33), it will exit through nozzles (34) on the lower portion of the inside of the chamber of the tank (11).

Air lines (40) are formed in the end walls of the tank (11) and have one-way valves (41) in the line. The top of the pipe (40) is in communication with the top of the chamber inside the tank (11), and the bottom of the pipe (40) is in communication with the line (33).

Figure 7:
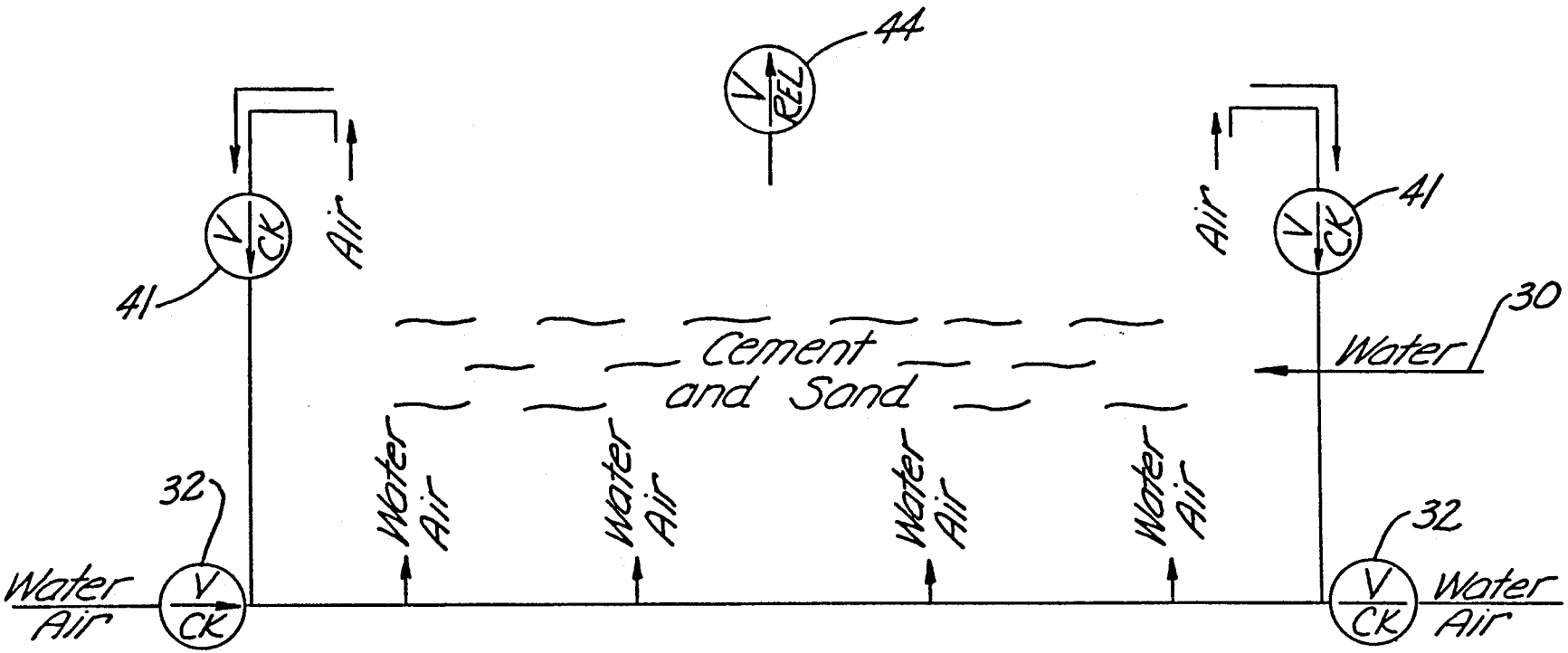
FIG. 7 is a schematic view of the water and air valve system of the present invention.

The pressure relief valve (44) is connected to the top of the tank as can best be seen in FIGS. 1 and 7.

Loops (45) are preferably metal hooks which are attached to the reinforcing rods (12) on the inside of the tank for facilitating the lifting and lowering of the apparatus (10) as will be explained below.

A shroud (46) is connected to the tank (11) as can best be seen in FIGS. 1 and 5 for funneling concrete out through outlet door (20). A flexible hose (47) is sealingly attached to the lip (48) at the bottom of the shroud (46) for allowing the concrete to pass out through the tank and out through the hose (47).

In operation, the tank (11) can either be on a metal stand or the like (not shown) on the ground, or it can be suspended slightly above the ground by flexible cables or chains (not shown) connected to loops (45). Cement and sand can be introduced by opening the inlet doors (13) while having the outlet doors (20) closed. Water can then be introduced through the line (30) and once the proper proportions of each of the ingredients making up the concrete are introduced to the inlets (13), the valves and inlet doors (13) are closed and sealed.

To mix the ingredients within the tank (11), air under pressure, for example from a compressor or the like, is introduced through the pipe (35), valve (36), pipe (31), one-way valve (32), and pipe (33) so that it will pass out through the nozzles (34) in the bottom of the chamber within the tank (11), as is shown in FIG. 1. The mixing of the concrete can be observed because of the clear tank (11) so that if, for example, there is not enough water in the concrete mix, more water can be added through the inlet (30). As the air passes through the nozzles (34) and through the concrete being mixed within the tank (11), the air will become pressurized at the top thereof, and this air can pass down through the return air pipe (40) and through one-way valve (41) to re-enter the pipe (33) to the extent that the pressure differential between the top of the tank (11) and the pipe (33) permit this to happen.

Once the concrete is sufficiently mixed to the desired viscosity, the hose (47) is connected to the shroud (46) as is shown in FIG. 5. The other end of the hose (47) is then directed to wherever the concrete is desired to be delivered, such as to an elevated multi-story building site which may be several stories above the level of the tank (11). By opening the outlet door (20) which is enclosed by the shroud (46), and leaving the other outlet door (20) closed, for example as shown on the left if FIG. 1, air under pressure can continue to be pumped into the tank (11) while the tank (11) is sealed, so that the high pressure within the tank (11) will force the concrete out through the hose (47) and to the place where it is to be delivered.

It is to be understood also that the tank (11) can be raised or lowered as is necessary to get it into close proximity to the cement and sand or whatever other ingredients are to be mixed inside the tank (11) and then it can be raised to whatever level is needed for convenient delivery of the concrete to the actual place where it is to be used. Consequently, the apparatus (10) can mix the concrete ingredients at any level and can deliver the concrete at any level, so long as there is a crane or other device available to raise and lower the apparatus (10).

Also, it is important to note that the configuration of the tank (11) is essentially elliptical so that when the air passes through the nozzles (34), the concrete will essentially be circulated to the top and then will fall down rather steep walls. This will enhance the mixing characteristics as compared to a strictly cylindrical tank with a circular cross section.

When it is desired to clean the tank (11), the air pipe (35) is disconnected by valve (36) and water is introduced under pressure through pipes (37), valve (38), pipe (31) and one-way valve (32) to the pipe (33). This will cause water to pass up and out through the nozzles (34) thereby washing and cleaning the inside of the tank (11). At this time, preferably the outlet doors (20) are open to allow the watered down concrete to pass out therethrough. During this process, the transparent tank (11) allows the user to observe the cleaning process and thereby know when it is complete. This is important because any concrete which hardens on the interior walls of the tank (11) will eventually cause maintenance problems.

The relief valve (44) is present as a safety feature so that if the air pressure during either the mixing phase or the delivery of concrete phase exceeds a predetermined value which might create a danger of the tank (11) exploding, the relief valve (44) will release such pressure as is necessary for safety purposes.

Accordingly it will be appreciated that the preferred embodiment disclosed herein does indeed the aforementioned objects. Obviously, many modifications and variations of the present invention are possible in light of the above teachings. It is therefore to be understood that, within the scope of the appended claims, the invention may be practiced otherwise than as specifically described.

I claim:

1. An apparatus for mixing concrete at the point of use at a building site having sources of compressed air and water even at elevated locations wherein the apparatus comprises:

a tank, said tank having a top, a bottom, a first and second side and a first and a second end, said tank having a chamber disposed therein which is generally elliptical in cross sectional shape; and, wherein said tank has at least a substantially translucent vertical height portion which permits both the level and the viscosity of the cement contained therein to be monitored;

reinforcing rods associated with said tank to impart rigidly thereto and means associated with the top of said tank and operatively connected to said reinforcing rods for permitting said tank to be lifted to said elevated locations at the building site;

inlet means disposed in the top of said tank for permitting concrete ingredients to be introduced therethrough;

means for selectively sealing said inlet means to that said chamber can be pressurized;

outlet means disposed in the bottom of said tank for permitting mixed concrete to be withdrawn from said chamber;

means attached to said tank for introducing air under pressure to a lower portion of the chamber in said tank;

conduit means connected to said tank for introducing water into said tank;

nozzle means disposed in a lower portion of said chamber for selectively introducing air and water into said chamber, means for connecting a supply of water under pressure to said nozzle means; and, means for connecting a supply of air under pressure to said nozzle means; including conduit means connecting a top portion of said chamber with said air supply means for permitting air to pass from the top of said chamber to said air supply means; and, further including a one-way valve means for permitting air to flow through said conduit means from the top of the chamber to the air supply means but preventing air from flowing from said air supply means directly to the top of the chamber through said conduit means; wherein, air flowing from the top of said chamber is mixed directly with air entering said chamber from said air supply means; and, wherein mixing takes place within said chamber.

2. The apparatus of claim 1 including a second water inlet conduit means attached to said tank for selectively introducing water into said tank; and wherein said tank is constructed of clear plastic.

3. The apparatus of claim 1 including a flexible concrete delivery hose means attached to said outlet means for selectively causing concrete to flow therethrough when said outlet means is open and said tank is pressurized by said air supply means.

* * * * *